United States Patent [19]

Condotta

[11] Patent Number: 4,809,495

[45] Date of Patent: Mar. 7, 1989

[54] AUTOMATIC SLIVER DISTRIBUTOR FOR SPINNING MACHINES

[76] Inventor: Roberto Condotta, Viale Monte Grappa 30, Treviso, Italy, 31100

[21] Appl. No.: 127,461

[22] Filed: Dec. 2, 1987

[30] Foreign Application Priority Data

Dec. 3, 1986 [IT] Italy ..... 83448 A/86

[51] Int. Cl.[4] ..... D01H 1/12

[52] U.S. Cl. ..... 57/408; 57/90

[58] Field of Search ..... 57/90, 91, 408–413; 19/159 R, 159 A

[56] References Cited

U.S. PATENT DOCUMENTS

| | | | |
|---|---|---|---|
| 4,022,007 | 5/1977 | Motobayashi et al. | 57/90 X |
| 4,033,104 | 7/1977 | Kamp | 19/159 A X |
| 4,078,369 | 3/1978 | Brandis | 57/90 X |
| 4,150,534 | 4/1979 | Raasch | 57/90 X |
| 4,381,638 | 5/1983 | Olsson | 57/408 X |
| 4,537,018 | 8/1985 | Tooka | 57/90 |
| 4,735,040 | 4/1988 | Pircher | 19/159 A X |

*Primary Examiner*—John Petrakes

*Attorney, Agent, or Firm*—Wegner & Bretschneider

[57] ABSTRACT

The present invention is directed to an automatic sliver distributor for spinning machines, the spinning units of which are fed from spinning cans of sliver positioned in cooperation with the spinning units, such spinning cans possibly having a horizontal cross-section which is circular or rectangular or with rounded short sides or of another shape. The distributor comprises a movable structure able to run parallel to at least one side of the spinning machine and bearing on its base at least one distribution can of sliver and a unit to distribute the sliver, such distribution can being suitable to contain a quantity of sliver several times greater than the quantity contained in a spinning can.

10 Claims, 1 Drawing Sheet

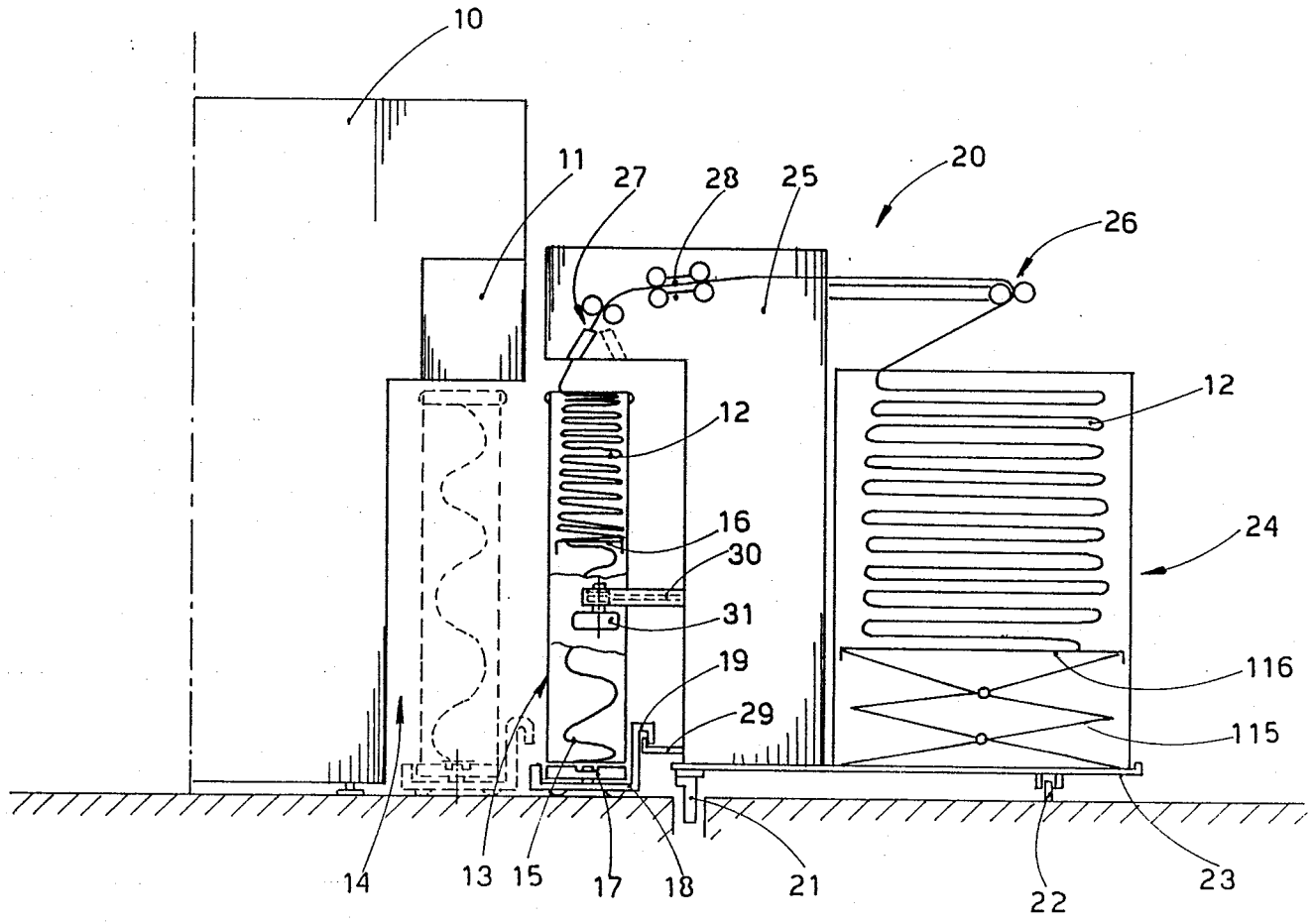
10
11
12
13
14
15
16
17
18
19
20
21
22
23
24
25
26
27
28
29
30
31
116
115

AUTOMATIC SLIVER DISTRIBUTOR FOR SPINNING MACHINES

BACKGROUND OF THE INVENTION

This invention concerns an automatic sliver distributor for spinning machines. To be more exact, the automatic sliver distributor can be applied advantageously to free-fibre spinning machines, which are called "open-end spinning machines".

However, when suitably adapted, the distributor can be employed with any spinning machine or other type of machine fed with sliver deposited in cans.

In the spinning field it is known that the feeding of machines from cans holding slivers of fibres takes place mainly with manual systems as regards the handling and positioning of the full and empty cans.

The full cans are taken from machines preparing the sliver and are borne on trolleys pushed by the appropriate personnel and are moved to a storage zone near the spinning machines.

The empty cans coming from the spinning machines follow the opposite path.

In the case of free-fibre, or open-end, spinning machines, to which we shall refer hereinafter in this disclosure without thereby limiting the field of application of the invention, the spinning machine operator uses the full cans when those already in use are emptied.

The cans are changed according to various criteria, depending on the properties of the yarn, the organization of the spinning mill, the type of machine, etc.

Such criteria can be broken down substantially into a random exchange when the sliver has been used up at any point in the machine, or an exchange by sections with replacement of a plurality of neighbouring cans in succession, or an exchange by machines with a complete replacement of all the cans being used as soon as they are all empty.

These systems for taking, carrying and depositing the full and empty cans entail noteworthy limits, particularly so with open-end spinning, which reaches high speeds of output yarn and therfore needs a supply of large quantities of sliver.

In particular, the open-end spinning machines are structured in such a way that they have very limited space available for the supply of cans of sliver, and the cans by necessity hold insufficient quantities to meet requirements and therefore have to be changed very often.

Moreover, the space required for storage of cans is very great, as also is the number of the cans themselves, and this represents a considerable cost for the spinning mills.

Owing to being continually moved the cans are subjected to wear and possible accidental damage, which cause cans to be wasted.

Furthermore, the handling of these cans requires personnel employed for this type of work and the related costs.

Some manufacturers have proposed automated systems for transporting the cans within the spinning mills but these solutions are very expensive and extremely inflexible to apply. In any event, these systems offer only equipment to move the cans from one storage point to another and form obstacles for normal movement within the spinning mill.

SUMMARY OF THE INVENTION

To obviate these shortcomings the present applicant has designed and tested an automatic sliver distributor according to the invention.

Such distributor according to the invention is applied advantageously, but not only, to spinning machines and eliminates the carriage and depositing of cans from such machines to and in storage points and viceversa.

The sliver distributor has a movable carriage structure which is moved along the face of a spinning machine by drawing means, which may be positioned on the floor, ceiling or wall.

Such carriage structure comprises support and anchorage means for cans, which are generally gill box cans of a large size several times greater than the spinning cans.

The automatic sliver distributor comprises, in front of the spinning machine, a sliver distributor unit with means to draw the sliver from the gill box can, means to guide the sliver and means to distribute the sliver within the spinning cans; such distributor means may be rotatable or may perform a to-and-fro movement, a geometric rectangular movement, an oval movement, etc.

According to a variant, means may be included impart a drafting action to the sliver.

The sliver distributor unit comprises attachment means cooperating with the spinning cans positioned to feed the spinning machine in the positioning of the cans during the loading of sliver.

In this way a considerable saving in the number of cans employed is obtained as the same spinning can is continuously either emptied by the spinning machines or filled by the automatic distributor.

The spinning can may have a circular, rectangular, oval or other horizontal cross-section.

According to a variant the spinning can has a substantially circular horizontal cross-section and the distributor unit also comprises means able to rotate the spinning can during filling, such means cooperating with corresponding rotatable means on the support of the spinning can.

In this way an excellent placement of sliver within the spinning can is obtained.

The invention is therefore embodied with an automatic sliver distributor for spinning machines, the spinning units of which are fed from spinning cans of sliver positioned in cooperation with the spinning units, such spinning cans possibly having a horizontal cross-section which is circular or rectangular or with rounded short sides or of another shape, which distributor is characterized in that it comprises a movable structure able to run parallel to at least one side of the spinning machine and bearing on its base, at least one distribution can of sliver and a unit to distribute the sliver, such distribution can being suitable to contain a quantity of sliver several times greater than the quantity contained in a spinning can.

BRIEF DESCRIPTION OF THE DRAWING

The sole FIGURE, which is given as a non-restrictive example, shows a functional diagram of the sliver distributor unit according to the invention.

DETAILED DESCRIPTION OF THE PREFERRED EMBODIMENTS

In the figure, a spinning machine 10 which is advantageously, but not necessarily, of the open-end type, comprises on one or two of its sides a plurality of spinning units 11 fed, in this example, from below by a sliver 12 of fibres coming generally from gill boxes of similar machines.

Such sliver of fibres 12 is contained in a spinning can 13 positioned below the spinning unit 11 in a space 14 suitably provided within the overall bulk of the machine 10 (see the part marked with dashes) so as to restrict the overall space taken up by the machine 10.

The spinning can 13 may have a horizontal cross-section which is circular, rectangular or oval or has rounded ends or is of another type that can be used for the purpose.

Spring 15 and sliver support 16, within the spinning can 13, enable the sliver 12 to be fed in a very satisfactory manner to the spinning unit 11 while the can 13 is gradually emptied.

If the spinning can 13 has a substantially circular horizontal cross-section, it can be installed on a plate 17 free to rotate on its own axis and forming part of a movable support 18 provided at its front with attachment means 19 towards the outside of the spinning machine 10.

The spinning can 13 lies in the position shown with dashes in the figure when in its working position at the spinning unit 11.

When the sliver 12 has been exhausted, as is shown by the dashed lines in the figure, the spinning unit 11 halts owing to the lack of feed and the spinning can 13 has to be filled again with sliver 12.

According to the invention an automatic sliver distributor 20 is driven along the side of the spinning machine 10 by driving means 21, such as a rack or the like, and by means of wheels 22, the driving means 21 providing also the support of the distributor 20.

In the example shown, the driving means 21 are positioned at floor level and are partially guided on means able to run, such as wheels 22, on the floor.

According to a variant the driving means 21 can be positioned on the ceiling or wall, and in such a case the automatic sliver distributor 20 will constitute a partially or wholly suspended structure.

The automatic distributor 20 consists of a base 23 which bears a distributor can 24, which generally comes from a gill box and contains sliver 12. A spring 115 and sliver support 116 perform the same task as in the spinning can 13.

The base 23 also supports a sliver distributor unit 25, which comprises the actuation and control means (not shown in the figure) needed for distribution of the sliver 12.

In particular, draw means 26 to draw the sliver from the distribution can 24 and feed means 27 to feed and distribute the sliver are included and are of a type already known in the art and specifically suited to the section of the spinning can 13.

According to one variation, at least one drafting unit 28 may be included.

Towards the side of the spinning machine 10 the distributor unit 25 comprises a movable lever 29 which cooperates with the attachment means 19 of the spinning can support 18 in withdrawing the spinning can 13 from the space 14 below the spinning unit 11.

The automatic distributor 20 runs along the side or sides of the spinning machine or machines 10 and halts, in correspondence with the spinning unit 11 halted through lack of sliver 12, when so commanded by control devices, which do not form part of this invention and are available in the prior art.

The distributor 20 actuates the movable lever 29, which in cooperation with the attachment means 19 brings the spinning can 13 to its filling position.

During filling, if the spinning can 13 has a substantially circular section, a movable arm 30 of the distributor unit 25 may be included to tangentially rotate the spinning can 13 by means of a wheel 31 or like means driven by known devices. Such rotation is made possible by cooperation of the movable arm 30 with the freely rotatable plate 17 of the movable support 18.

When filling has taken place, the movable arm 30 retreats and the movable lever 29, before retreating, re-positions the spinning can 13 in its space 14 for a new supply to the spinning unit 11.

Being summoned by a successive spinning unit 11, the distributor 20 departs, while the machine operator or an appropriate known automatic control system takes steps to re-start the spinning unit 11.

When the distribution can 24 of the gill box has been emptied, the distributor 20 will be sent to an appropriate station for replacement of the distribution can 24.

If included, the movable arm 30 may also be of a type able to take the spinning can 13 independently and make it rotate momentarily with its own means.

If the spinning can 13 has a horizontal cross-section that is not circular, then the movable arm 30 may be enabled to perform a lateral to-and-fro movement.

I claim:

1. An automatic sliver distributor for spinning machines, the spinning units of which are fed from spinning cans of sliver positioned in coooperation with said spinning units, said distributor comprising:

a movable structure movable parallel to at least one side of said spinning machine, said movable structure carrying on its base at least one distribution can of sliver and a distribution unit for distributing the sliver into said spinning cans to fill said spinning cans with sliver after being emptied by said spinning units, said distribution can being suitable to contain a quantity of sliver several times greater than the quantity contained in said spinning can.

2. An automatic sliver distributor as claimed in claim 1, in which the sliver distributor unit comprises at least one unit to draw sliver from said distribution can and a unit to distribute the sliver into said spinning cans serving the spinning unit.

3. An automatic sliver distributor as claimed in claim 1 in which said distribution unit distributing the sliver comprises at least one unit to draft the sliver.

4. An automatic sliver distributor as claimed in claim 1, in which said spinning cans are installed on movable supports, at least temporarily.

5. An automatic sliver distributor as claimed in claim 4, in which said distribution unit distributing the sliver comprises a coupling lever momentarily positioned to cooperate with an attachment of said movable support of said spinning cans in the positioning of said spinning cans during the filling step.

6. An automatic sliver distributor as claimed in claim 1, in which said distribution unit distributing the sliver comprises a movable arm which cooperates momentarily with said spinning can to obtain coordinated displacement of said spinning can during the filling of the latter with sliver.

7. An automatic sliver distributor as claimed in any claim 1, in which said movable structure of the distributor is a structure having driving means positioned at floor level.

8. An automatic sliver distributor as in claim 1 wherein said spinning can has a circular horizontal cross-section.

9. An automatic sliver distributor as in claim 1 wherein said spinning can has a rectangular horizontal cross-section.

10. An automatic sliver distributor as in claim 1 wherein said spinning can has a horizontal cross-section with rounded shortsides.

* * * * *